US007620197B2

(12) United States Patent
Han et al.

(10) Patent No.: US 7,620,197 B2
(45) Date of Patent: Nov. 17, 2009

(54) CASING OF CONDENSER MICROPHONE

(75) Inventors: Kyoungku Han, Gwangmyeong-si (KR); Sukjin Kim, Incheon-si (KR); Kyunghwan Kang, Siheung-si (KR)

(73) Assignee: BSE Co., Ltd. (KR)

( * ) Notice: Subject to any disclaimer, the term of this patent is extended or adjusted under 35 U.S.C. 154(b) by 708 days.

(21) Appl. No.: 11/349,870

(22) Filed: Feb. 8, 2006

(65) Prior Publication Data

US 2006/0262953 A1 Nov. 23, 2006

(30) Foreign Application Priority Data

Apr. 29, 2005 (KR) ..... 10-2005-0035946

(51) Int. Cl.
*H04R 25/00* (2006.01)

(52) U.S. Cl. ..... 381/369; 381/361; 29/594

(58) Field of Classification Search ..... 381/355, 381/358, 360, 361, 369, 170–181; 29/594
See application file for complete search history.

(56) References Cited

FOREIGN PATENT DOCUMENTS

| | | | |
|---|---|---|---|
| EP | 1635608 | A1 | 3/2005 |
| GB | 2253117 | A | 8/1992 |
| JP | 4-257200 | | 9/1992 |
| JP | 05060079 | | 6/1993 |
| JP | 6002899 | | 1/1994 |
| JP | 2001-339794 | | 12/2001 |
| JP | 2002534933 | T | 10/2002 |
| JP | 2004135223 | | 4/2004 |
| KR | 0218653 | | 4/2001 |
| KR | 0332944 | | 11/2003 |
| WO | WO 02/49393 | A1 | 6/2002 |
| WO | 2004107809 | A1 | 12/2004 |

*Primary Examiner*—Suhan Ni
(74) *Attorney, Agent, or Firm*—Cantor Colburn LLP

(57) ABSTRACT

The casing of a condenser microphone in accordance with the present invention comprises a groove at a bottom surface of the casing along an outer circumference of the bottom surface for preventing a deformation of a component during a curling process of an open end portion of the casing, wherein the casing for housing the component therein consists of a metallic material, the casing having an acoustic hole at the bottom surface thereof, the open end portion of the casing being at an opposite side of the bottom surface.

3 Claims, 6 Drawing Sheets

CASING OF CONDENSER MICROPHONE

FIELD OF THE INVENTION

The present invention relates to a casing of a condenser microphone, and in particular, to a casing of a condenser microphone which prevents a deformation of a component during a curling process.

BACKGROUND OF THE INVENTION

A typical microphone comprises a voltage bias element (commonly, consists of an electret), a diaphragm/backplate pair forming a variable capacitor according to an acoustic pressure, and a JFET (junction field effect transistor) for buffering an output signal. An electret condenser microphone comprises an electret on one of the diaphragm and the backplate. A front electret refers to a case where the electret is formed on the diaphragm, and a back electret refers to a case where the electret is formed on the backplate. Commonly, the electret is formed by forcibly injecting a charge into an organic film.

FIG. 1 is cross-sectional view illustrating a conventional condenser microphone assembly using a casing. Referring to FIG. 1, the conventional condenser microphone assembly has a structure wherein a vibrating plate 12 including a diaphragm 12*a* and a polar ring 12*b*, a spacer 13, a first base 14, a back plate 15, a second base 16, and a PCB 18 are inserted into a casing 10 having an acoustic hole 10*c* at a bottom surface thereof, and then an end portion 10*b* of the casing is curled.

The second base 16 carries out a function of mechanically fixing the inserted internal component as well as a function of transmitting an electrical signal generated from a microphone unit (vibrating plate/back electret) to JFET, an amplifier or a device including an amplifier and an AD converter.

In addition, the PCB 18 presses the second base 16 because a height of the second base 16 is higher than that of the first base 14.

However, when the conventional casing is used, a folded surface 10*a* between a bottom surface and a sidewall of the casing 10 has a certain curvature due to a limitation in a processing technology. Therefore, the component disposed on the bottom surface of the casing 10 is in contact with a curved surface to be deformed. That is, when the vibrating plate 12 is inserted on the bottom surface of the casing, other components are disposed thereon and the end portion 10*b* of the casing is curled, a pressure is applied inward to the components by a curling process to bend the polar ring of the vibrating plate 12 due to an edge portion of the vibrating plate 12 touching the curved surface of the folded surface 10*a* of the casing. Therefore, the diaphragm is deformed, resulting in a degradation of a sensitivity and a frequency characteristic of the microphone.

DETAILED DESCRIPTION OF THE INVENTION

It is an object of the present invention to provide a casing of a condenser microphone wherein a groove is formed along an outer circumference where a bottom surface and a sidewall of the casing meet to prevent a deformation of a component.

In order to achieve the above object of the invention, there is provided a casing of a condenser microphone, the casing comprising: a groove at a bottom surface of the casing along an outer circumference of the bottom surface for preventing a deformation of a component during a curling process of an open end portion of the casing, wherein the casing for housing the component therein consists of a metallic material, the casing having an acoustic hole at the bottom surface thereof, the open end portion of the casing being at an opposite side of the bottom surface.

As described above, in accordance with the casing of the condenser microphone of the present invention, a groove is formed along an outer circumference where a bottom surface and a sidewall of the casing meet to prevent a deformation of a component and improve a yield.

While the present invention has been particularly shown and described with reference to the preferred embodiment thereof, it will be understood by those skilled in the art that various changes in form and details may be effected therein without departing from the spirit and scope of the invention as defined by the appended claims.

PREFERRED EMBODIMENTS

The above-described objects and other objects and characteristics and advantages of the present invention will now be described in detail with reference to the accompanied drawings.

Figure 1:
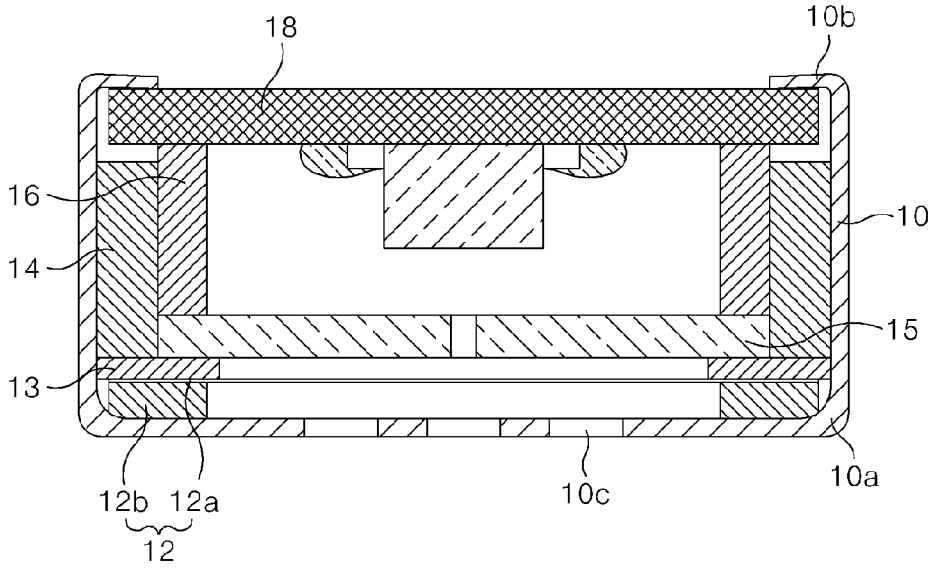
Fig. 1 (PRIOR ART)
FIG. 1 is cross-sectional view illustrating a conventional condenser microphone assembly using a casing.
Figure 2A:
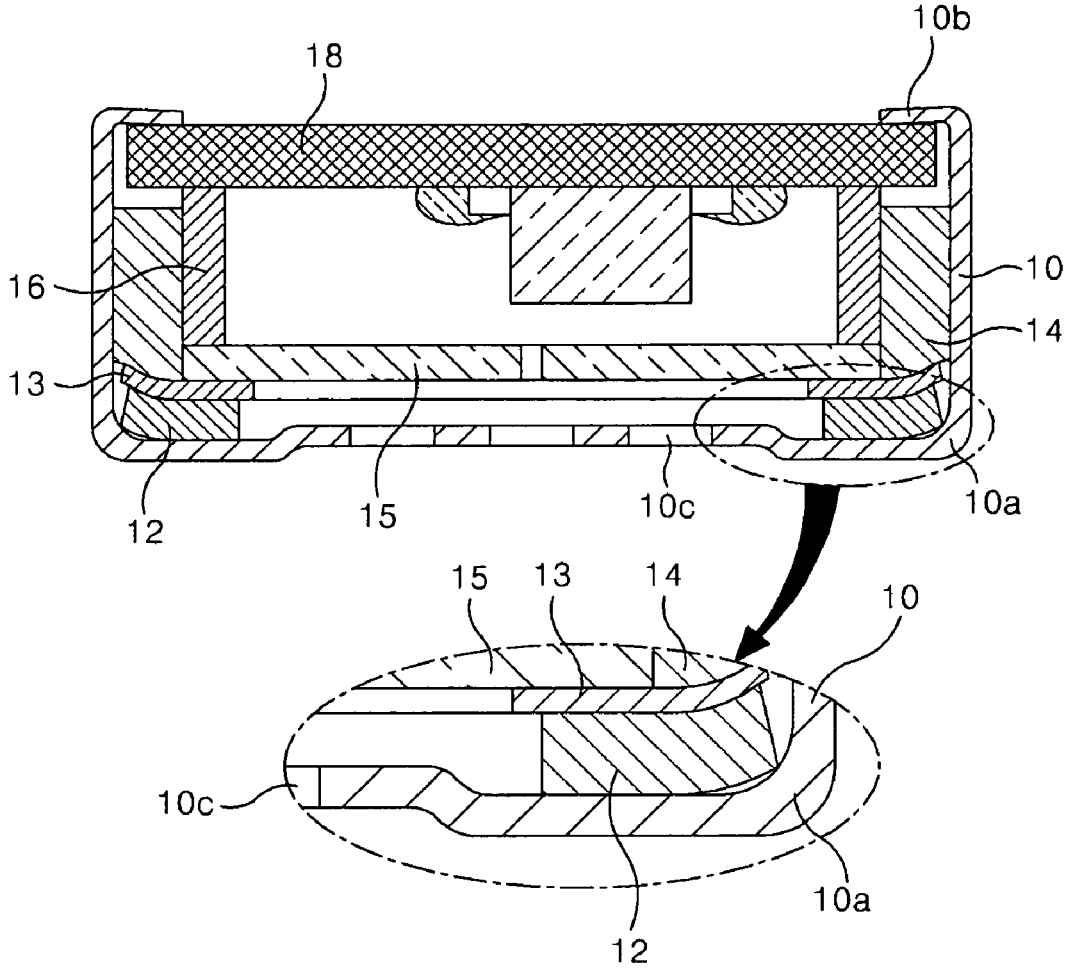
FIGS. 2*a* through 2*d* are diagrams illustrating a principle of the present invention.
Figure 2B:
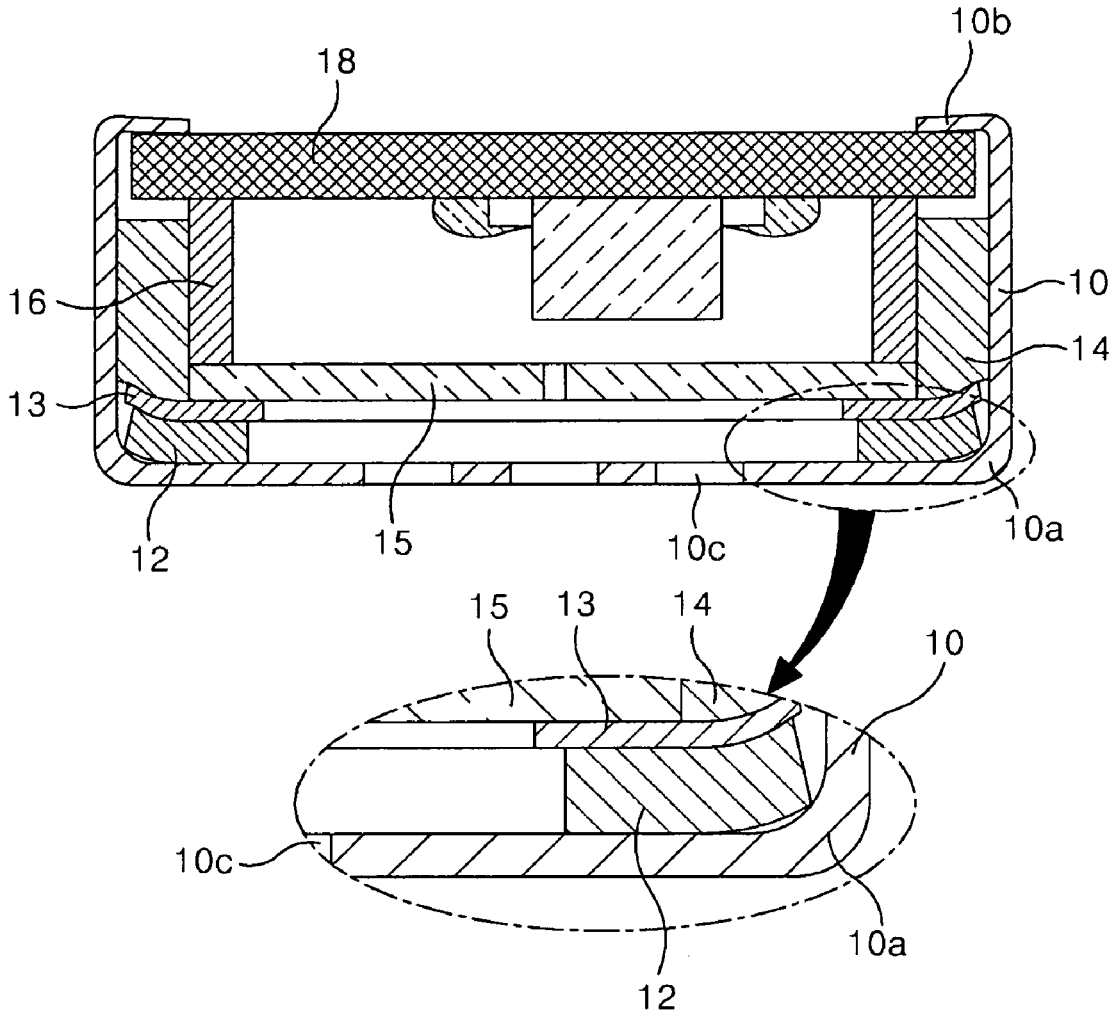
Figure 2C:
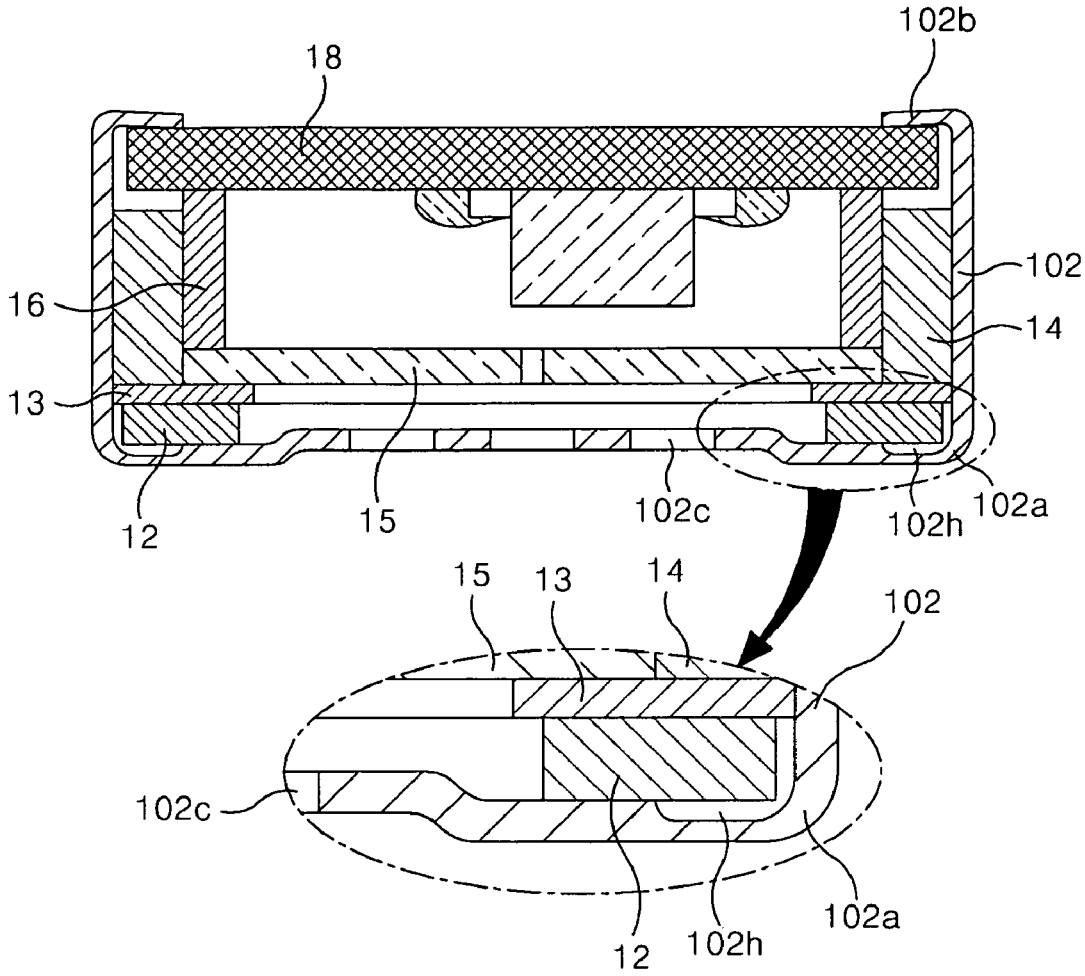
Figure 2D:
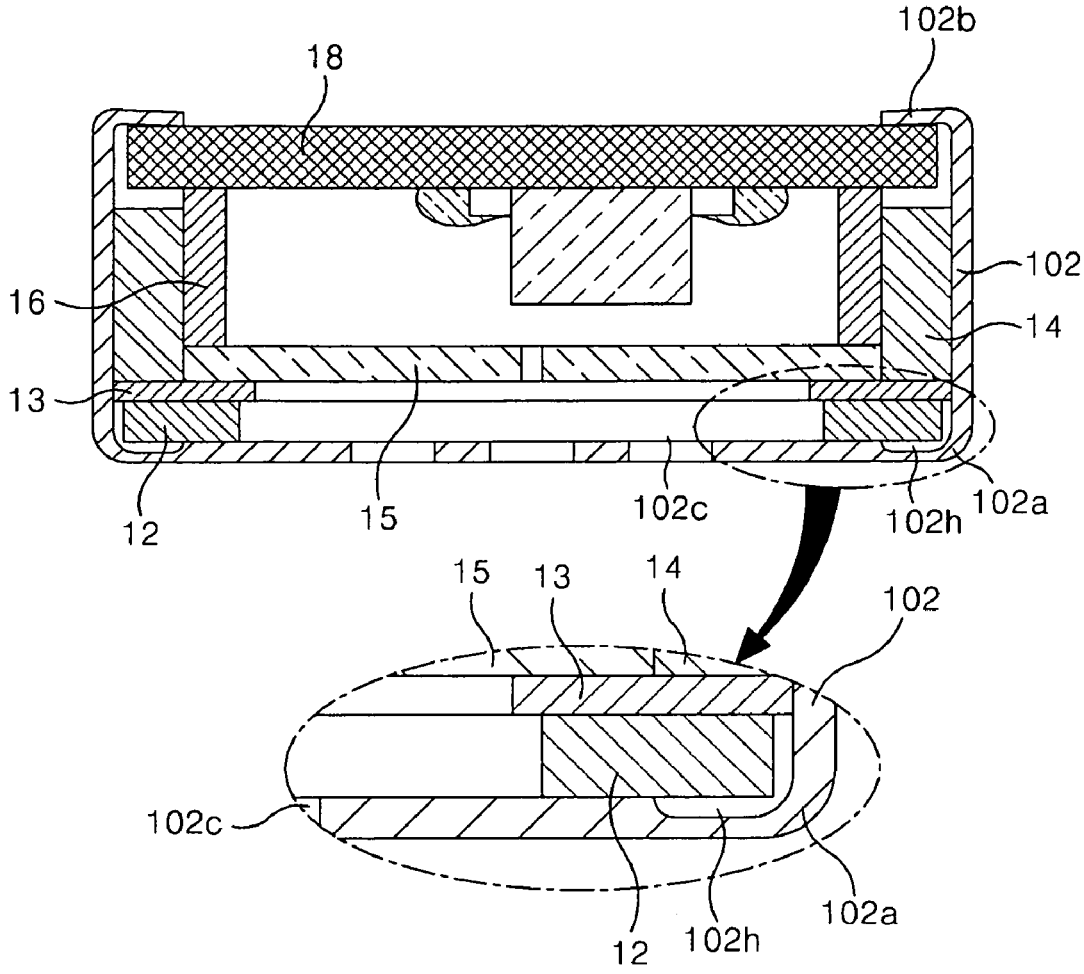

FIGS. 2*a* through 2*d* are diagrams illustrating a concept of the present invention, wherein FIGS. 2*a* and 2*b* illustrate a concept of deformation of components when the conventional casing is used, and FIGS. 2*c* and 2*d* illustrate a concept of non-deformation when the casing in accordance with the present invention is used.

In addition, there are two types of the casing used in a microphone. One is a casing having a concaved portion where an acoustic hole is formed at a bottom surface of the casing, and the other is a casing having a flat bottom surface. FIGS. 2*a* and 2*c* illustrates the casing having the concaved portion and FIGS. 2*b* and 2*d* illustrates the casing having the flat bottom surface.

Referring to FIGS. 2*a* and 2*b*, the conventional condenser microphone assembly has a structure wherein a vibrating plate 12 including a diaphragm and a polar ring, a spacer 13, a first base 14, a back plate 15, a second base 16, and a PCB 18 are inserted into a casing 10 having an acoustic hole 10*c* at a bottom surface thereof, and then an end portion 10*b* of the casing is curled. As shown in FIGS. 2*a* and 2*b*, a folded surface 10*a* between a bottom surface and a sidewall of the casing 10 has a certain curvature so that the component disposed at the bottom surface is deformed by contacting the a curved surface. The assembled microphone frequently has a degraded sensitivity and a poor frequency characteristic due to the deformation.

In order to solve this problem, the present invention comprises a groove 102*h* for preventing the deformation of the component formed at the bottom surface of the casing 102 along an outer circumference thereof as shown in FIGS. 2*c* and 2*d*.

Referring to FIGS. 2*c* and 2*d*, a box-type casing 102 consisting of metallic material has one open end portion and a bottom surface having an acoustic hole 102*c* opposite to the open end portion. The casing 102 includes a groove 102*h* at the bottom surface along the outer circumference where the bottom surface and the sidewall meet.

Components such as a vibrating plate 12, a spacer 13, a first base 14, back plate 15 and a second base 16 are inserted into the casing 102 having the groove 102*h* at the bottom surface along the outer circumference, and a PCB 18 is finally inserted and then the open end portion 102*a* is curled toward the PCB 18 to complete the microphone assembly.

The present invention is not limited by these conditions, a shape and order of the components housed in the casing 102 varies according to type of the microphone.

As described above, in accordance with the assembled microphone using the casing 102 of the present invention, the component is not in contact with the curved surface of the folded surface 102*a* because of the groove 102*h* formed at the bottom surface along the outer circumference thereof so that the deformation of the component is prevented during the curling process, thereby preventing a degradation of an acoustic quality of the microphone as shown in FIGS. 2*c* and 2*d*. That is, a bending of the component due to the curved surface is prevented because the curved surface of the folded surface 102*a* is disposed lower than the component by the groove 102*h* of the present invention.

Figure 3:
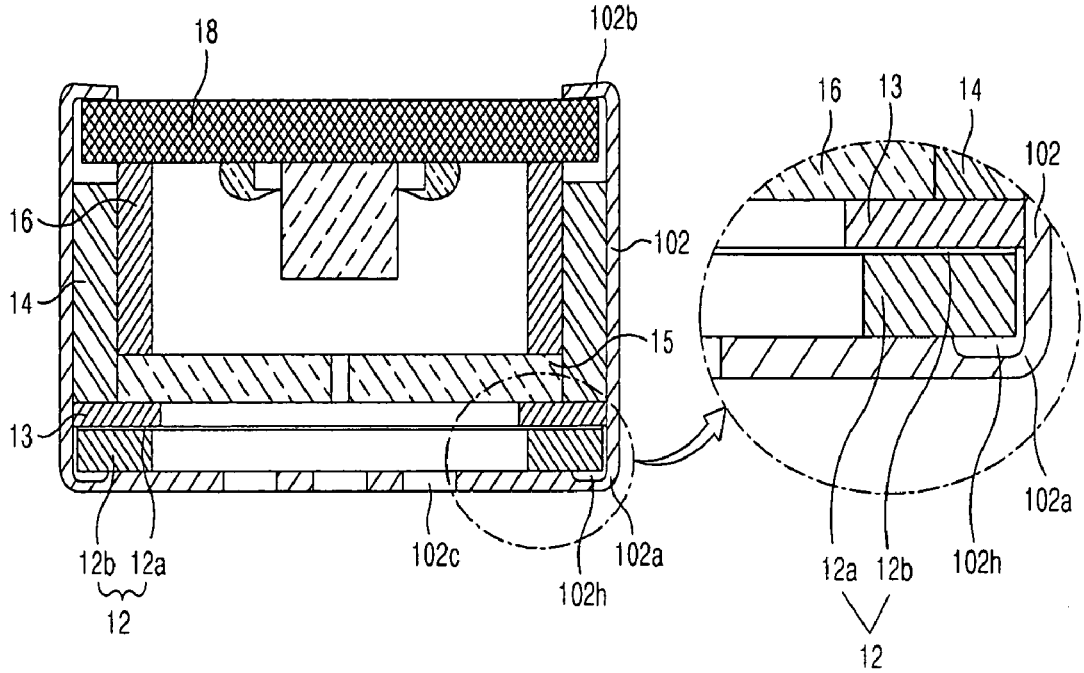
FIG. 3 is a cross-sectional view illustrating a condenser microphone assembly using a casing in accordance with a first embodiment of the present invention.

FIG. 3 illustrates a particular embodiment of the microphone assembly using the casing of present invention wherein a cross-section of the condenser microphone assembly is shown.

As shown in FIG. 3, a box-type casing 102 consisting of metallic material has one open end portion and a bottom surface having an acoustic hole 102*c* opposite to the open end portion. The bottom surface is flat and a groove 102*h* for preventing a deformation of a component is formed at the bottom surface along the outer circumference where the bottom surface and the sidewall meet.

A vibrating plate 12 including a diaphragm 12*a* and a polar ring 12*b*, a spacer 13, a first base 14, a back plate 15 and second base 16 are inserted into the casing 102 having the groove 102*h*, and a PCB 18 is finally inserted and then the open end portion 102*a* is curled toward the PCB 18 to complete the microphone assembly.

The second base 16 carries out a function of mechanically fixing the inserted internal component as well as a function of transmitting an electrical signal generated from a microphone unit (vibrating plate/back electret) to JFET, an amplifier or a device including an amplifier and an AD converter.

In addition, the PCB 18 presses the second base 16 because a height of the second base 16 is higher than that of the first base 14.

However, as described above, in accordance with the assembled microphone using the casing 102 of the present invention, the component is not in contact with the curved surface of the folded surface 102*a* because of the groove 102*h* formed at the bottom surface along the outer circumference thereof so that the deformation of the component is prevented during the curling process, thereby preventing a degradation of an acoustic quality of the microphone. That is, a bending of the polar ring 12*b* due to the curved surface is prevented because the curved surface of the folded surface 102*a* is disposed lower than the polar ring 12*b* by the groove 102*h* of the present invention.

INDUSTRIAL APPLICABILITY

A casing of a condenser microphone wherein a groove is formed along an outer circumference where a bottom surface and a sidewall of the casing meet to prevent a deformation of a component is provided.

What is claimed is:

1. A casing of a condenser microphone, the casing comprising:

a groove at a bottom surface of the casing along an outer circumference of the bottom surface for preventing a deformation of a component during a curling process of an open end portion of the casing, wherein the casing for housing the component therein consists of a metallic material, the casing having an acoustic hole at the bottom surface thereof, the open end portion of the casing being at an opposite side of the bottom surface.

2. The casing in accordance with claim 1, wherein the casing has a circular or a rectangular cylinder shape.

3. The casing in accordance with claim 1, wherein the bottom surface of the casing is flat or concaved at a portion where the acoustic hole is disposed.

* * * * *